US005753870A

United States Patent [19]

Schlaegel et al.

[11] Patent Number: 5,753,870

[45] Date of Patent: May 19, 1998

[54] CONTINUOUS FLOW EARMOLD TUBING CONNECTOR WITH A FILTER

[76] Inventors: Norman D. Schlaegel, 34439 Bentey Pl., Fremont, Calif. 94555; Chester J. Jelonek, 2704 Glascow Ct., Richmond, Calif. 94806

[21] Appl. No.: 546,702

[22] Filed: Oct. 23, 1995

[51] Int. Cl.[6] ..... H04R 25/00

[52] U.S. Cl. ..... 181/129; 181/130; 381/68

[58] Field of Search ..... 181/129, 130, 181/135; 381/68.2, 68.4, 69

[56] References Cited

U.S. PATENT DOCUMENTS 3,930,560 1/1976 Carlson et al. ..... 181/129
4,349,082 9/1982 Gastmeier ..... 181/130
4,381,830 5/1983 Jelonek et al. ..... 181/129
4,852,683 8/1989 Killion ..... 181/130

*Primary Examiner*—Khanh Dang
*Attorney, Agent, or Firm*—Adrian J. La Rue

[57] ABSTRACT

A connector connects sound conduction tubing from a hearing aid to a sound conduction bore in an earmold. The connector is an elbow-shaped member with one end receiving a filter and an end of the sound conduction tubing while the other end has latching means that latchably mate with an entry section of the sound conduction bore. The inside diameter of the sound conduction tubing, the diameter of a sound conduction tubular passage in the elbow-shaped member and the diameter of the sound conduction bore are the same theralong thereby defining a continuous flow sound conduction path from the hearing aid to the end of a canal of the earmold.

5 Claims, 2 Drawing Sheets

CONTINUOUS FLOW EARMOLD TUBING CONNECTOR WITH A FILTER

FIELD OF THE INVENTION

The present invention relates to connectors and more particularly to connectors including a filter therein for connecting sound conduction tubing to a sound conduction opening in an earmold.

BACKGROUND OF THE INVENTION

U.S. Pat. No. 4,381,830 discloses a continuous flow earmold tubing connector or continuous flow adapter-CFA-that connects sound conduction tubing from an ear hook of a hearing aid to an earmold that fits within a person's ear. The important feature of the invention disclosed in the patent is the diameter of the sound conduction passage in the connector or adapter is the same as the internal diameter of the sound conduction tubing. This provides a smooth and continuous path along the sound conduction tubing and the connector from the hearing aid to the earmold whereby the acoustical characteristics of amplified sound emanating from the hearing aid and traveling along the smooth and continuous path into the ear is not changed thereby resulting in improved amplified sound reaching the ear.

Whereas the CFA improves the amplified sound reaching the ear from the hearing aid, it is desirable to better shape the output and increase the gain from the hearing aid to achieve desired electroacoustic effects for persons wearing the hearing aids.

SUMMARY OF THE INVENTION

An object of the present invention is to provide a connector including a filter therein for connecting sound conduction tubing from a hearing aid to a sound conduction passage of an earmold with the filter acting to better shape the output and increase the gain from the hearing aid.

Another object of the present invention is the provision of a connector having a bore at one end in which a filter is positioned and an end of a sound conduction tubing from a hearing aid with the sound conduction tubular passage extending through the connector having a diameter the same as the internal diameter of the sound conduction tubing.

The present invention is realized by an elbow-shaped connector having a sound conduction tubular passage therealong which has the same diameter along its length. One leg of the elbow-shaped connector has a tubing-receiving section for receiving an end of a sound conduction tubing and a filter therein; the internal diameter of the sound conduction tubing is the same as the diameter of the sound conduction tubular passage in the elbow-shaped connector. The other leg of the elbow-shaped connector has a nubbin having a conically-shaped barb for insertion in an outer section of a sound conduction bore of an earmold.

The foregoing and other objects and advantages of the invention will more fully appear from the following description by way of example of an embodiment of the invention when taken in connection with the accompanying drawings.

DETAILED DESCRIPTION OF THE INVENTION

Figure 1:
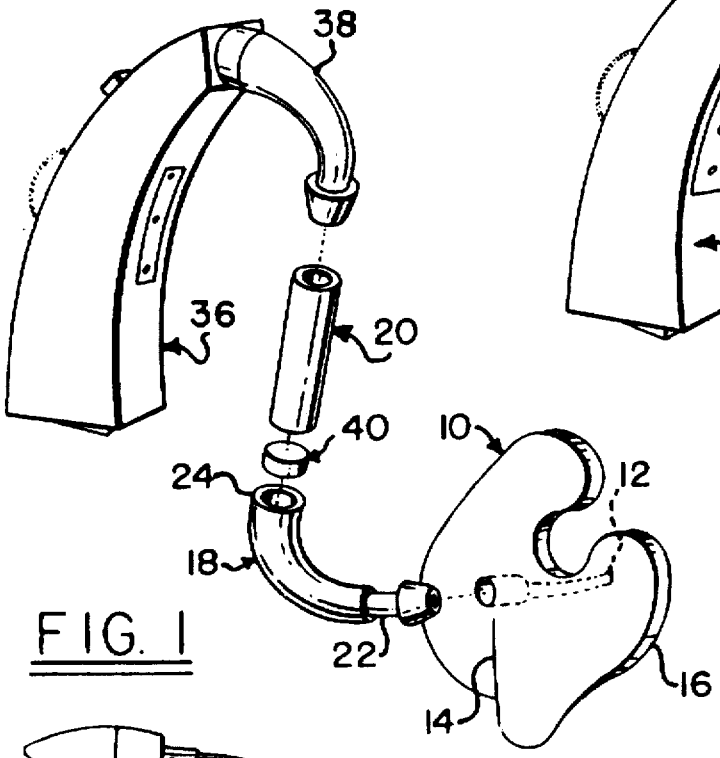
FIG. 1 is a perspective and exploded view of an earmold, earmold tubing connector, sound conduction tubing, filter and hearing aid.
Figure 2:
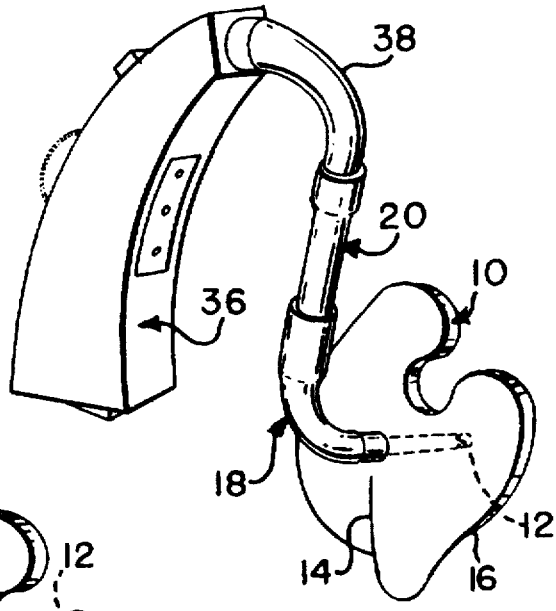
FIG. 2 is a view similar to FIG. 1 with the parts assembled together.
Figure 3:
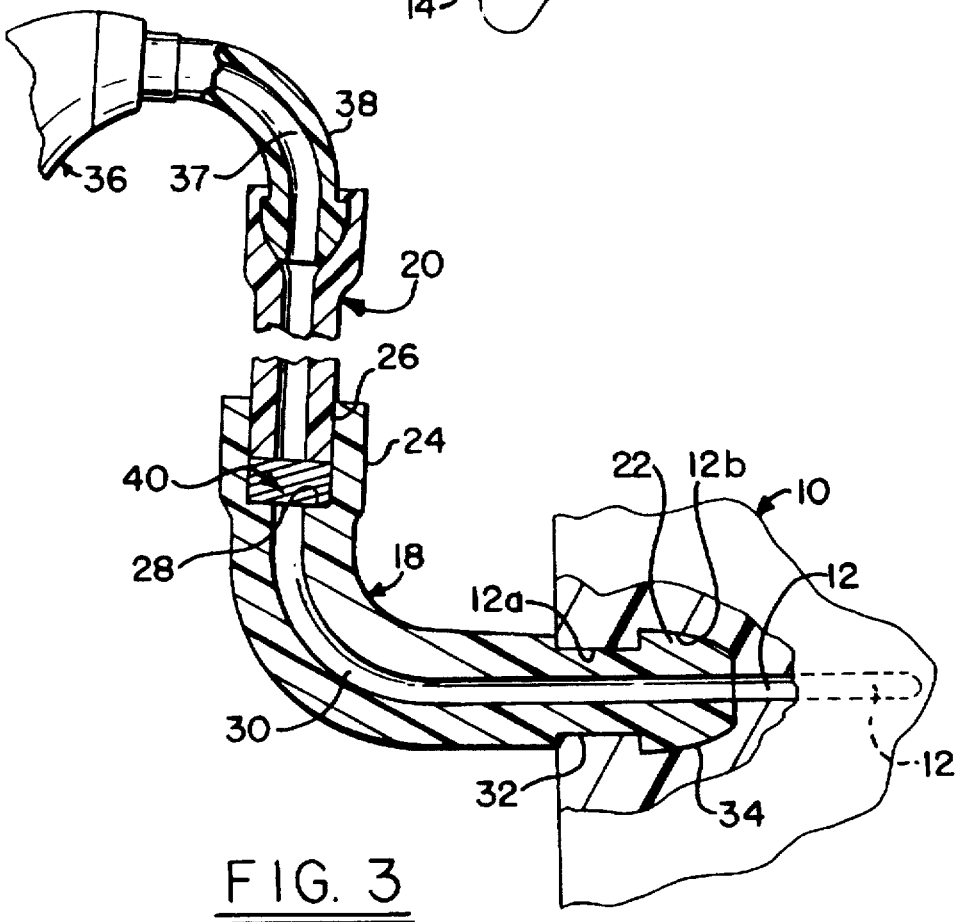
FIG. 3 is a cross-sectional view of part of the earmold, earmold tubing connector, filter, sound conduction tubing and part of the hearing aid.

A conventional earmold 10 is molded from a suitable plastic material to conform to and frictionally fit within a person's ear. The earmold is a pliable plastic that is compressible when finger and thumb pressure is applied thereto which classifies it as a soft plastic material. The earmold can also be made of a hard plastic material such as Lucite plastic.

The earmold 10 includes a sound conduction or sound bore 12 extending from the bridge 14 and through the canal 16 which extends into the ear canal. The outer part of sound conduction bore 12 has a nubbin-receiving section defining section **12*a* having a diameter larger than bore 12 and a section 12*b* in the form of a frustum of a cone; bore 12 has the same diameter therealong from section 12*b* to the end of canal 16**.

A connector 18 is molded from a suitable plastic material such as clear vinyl. It is elbow-shaped and has a bend of about 80 degrees for a better fit into sections **12*a* and 12*b* of bore 12, retention of the connector therein and orientation to receive one end of sound conduction tubing 20 therein which is also made of clear vinyl plastic like connector 18**.

Connector 18 has a nubbin 22 at one end and a tubing-receiving section 24 at the other end. Tubingreceiving section 24 has a bore 26 that has a diameter only slightly larger than the outside diameter of sound conduction tubing 20 so that tubing 20 can be readily fitted within bore 26 against filter 40 which abuts shoulder 28 with a conventional vinyl glue being used to secure tubing 20 within connector 18.

A sound conduction tubular passage 30 extends through connector 18 from bore 26 to the outer end of nubbin 22 and its diameter is the same as the inside diameter of sound conduction tubing 20 thereby defining a sound conduction path having the same diameter therealong.

Nubbin 22 has a conically-shaped surface of reduced diameter 34 and a conically-shaped barb 32 which mate with and conform to sections **12*a* and 12*b* respectively of sound conduction bore 12 in earmold 10 when nubbin 22 is force fitted into the nubbin-receiving section of bore 12. This can be done because connector 12 is flexible and nubbin 22** can be fitted into the nubbin-receiving section.

When nubbin 22 is fitted into the nubbin-receiving section of bore 12 so that reduced-diameter surface 32 fits with section 12*a* and conically-shaped barb 34 fits within section 12*b*, a sealed connection is made and nubbin 22 is latchably secured with the nubbin-receiving section of bore 12 to connect sound conduction tubing 20 to the sound conduction bore 12 of earmold 10. This arrangement enables connector 18 to be easily unlatched from the earmold to enable tubing 20, connector 18 and bore 12 to be cleaned.

The diameter of bore 12 from section 12*b* to the outer end of canal 16 is the same as sound conduction tubular passage 30. Thus, when tubing 20 is secured within bore 26 of connector 18 and nubbin 22 is latchably connected within sections 12*a* and 12*b* of bore 12, a sound conduction path of the same diameter extends therealong which does not change the acoustical characteristics of amplified sound emanating from hearing aid 36 which has its ear hook 38 connected onto sound conduction tubing 20. Hearing aid 36 can be a behind the ear or spectacles hearing aid. The sound conduction passageway 37 in the ear hook 38 and in the spectacles hearing aid has a diameter the same as the internal diameter of the sound conduction tubing. In this way, the fidelity of the frequencies of sound signals amplified by the hearing aid are more true because the sound conduction path along the sound conduction passageway, the sound conduction tubing, the sound conduction tubular passage and the sound conduction bore has the same diameter therealong.

Whereas, the sound conduction path along the sound conduction passageway 37 of the ear hook 38, the sound conduction tubing 20, the sound conduction tubular passage 30 of the connector 18 and the sound conduction bore 18 of the earmold 10 has the same diameter therealong, this results in the fidelity of the frequencies of sound signals amplified by the hearing aid being more true. Adding filter 40 within bore 26 of connector 18 at the end of the sound conduction tubing 20 more effectively shapes the output and gain of the amplified signals from the hearing aid 36 thereby achieving much better electroacoustic effects.

Figure 4:
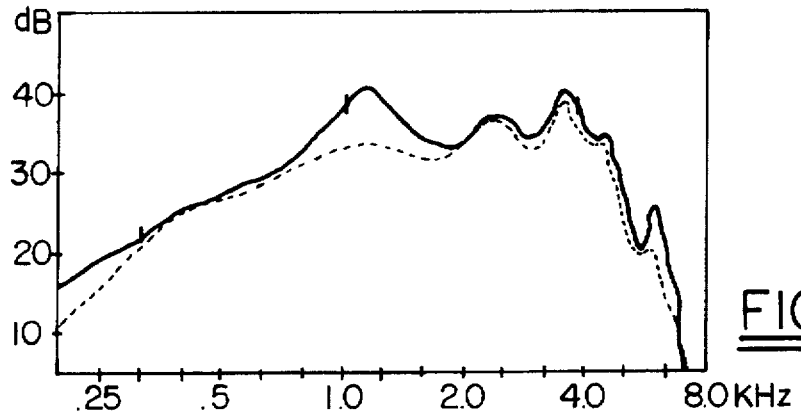
FIG. 4 is a graph showing the gain measurement in the presence of a speech weighted composite signal of 70dB input when using a standard continuous flow adapter (CFA) and tubing when compared with a 680 ohms filtered CFA and tubing.
Figure 6:
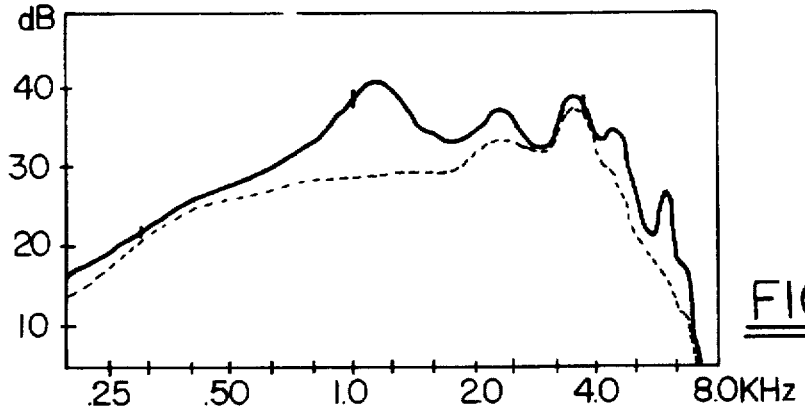
FIG. 6 is a graph similar to FIG. 4 showing the gain measurement in the presence of a speech-weighted composite signal of 70dB input when using a standard CFA and tubing when compared with a 1500 ohms filtered CFA and tubing.

As shown in the graph depicted in FIG. 4, the upper curve shows the gain measurement operational characteristics of a hearing aid using a standard continuous flow adapter without the use of filter 40 of a speech-weighted composite signal at a 70dB input within a frequency range of 0 to 8 kilohertz. The bottom curve of FIG. 4 shows the use of filter 40 of 680 ohms, whereby the curve is much smoother in the 1 kilohertz range. A similar situation occurs when the filter 40 is 1500 ohms as shown in the graph of FIG. 6 with the upper curve showing the gain measurement when using a standard continuous flow adapter without the use of filter 40 of the same speech-weighted composite signal at a 70dB input; whereas the bottom curve shows the use of a filter 40 of 1500 ohms.

Figure 5:
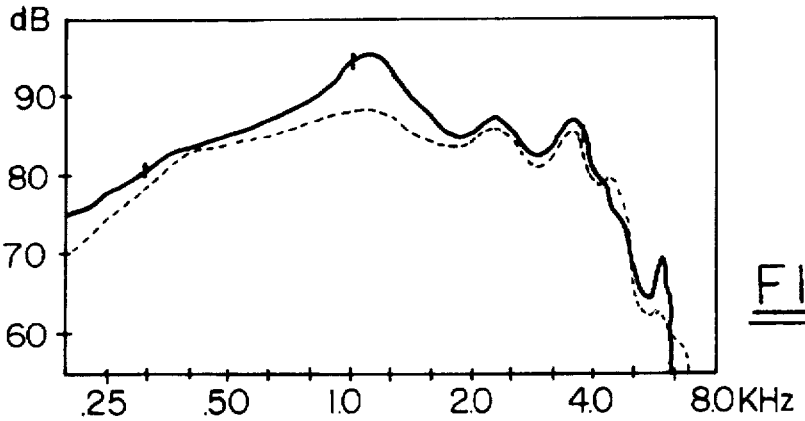
FIG. 5 is a graph similar to FIG. 4 showing the output measurement in the presence of a speech-weighted composite signal of 70dB input when using a standard CFA and tubing when compared with a 680 ohms filtered CFA and tubing.
Figure 7:
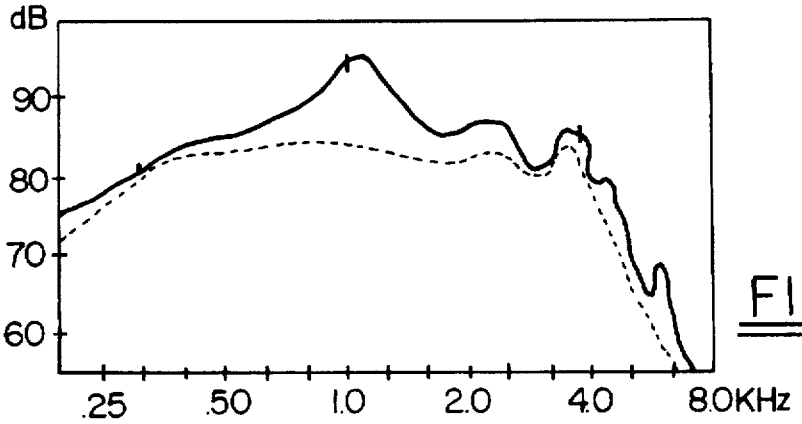
FIG. 7 is a graph similar to FIG. 4 showing the output measurement in the presence of a speech-weighted composite signal of 70dB input when using a standard CFA adapter and tubing when compared with a 1500 ohms filtered CFA and tubing.

FIGS. 5 and 7 show the graphs of the output measurement of a hearing aid when a speech-weighted composite signal of 70dB input is applied to a hearing aid. The upper curves in these graphs show the output measurement when the hearing aid uses a standard continuous flow adapter without a 680 ohms or 1500 ohms filter; whereas the bottom curves of these graphs show the use of a filter 40 of 680 ohms and 1500 ohms as part of the continuous flow adapter.

The output measurement is substantially smoother over the frequency range when the filter is used in the connector 18.

The invention has been described as using a filter of 680 and 1500 ohms. Other filters having a desired resistance can be used in accordance with the specific needs. These filters are conventional and are manufactured by Knowles Electronics, Inc., Itasco, Ill.

From the foregoing, it can be discerned that the use of a filter in a continuous flow adapter as part of a hearing aid system smooths the frequency response and gives a more comfortable performance. This permits operation at higher average sound pressure levels with substantially improved effectiveness to the hearing impaired.

We claim:

1. A hearing aid system, comprising:

a hearing aid having sound conduction means;

a sound conduction tubing having a first end connected to said sound conduction means;

an earmold having a sound conduction bore extending therethrough, said sound conduction bore having an entry section and an exit section;

a connector member having an elbow configuration and including a tubing-receiving section, a latching section, and a sound conduction tubular passage extending from said tubing-receiving section to an outer end of the latching section, said latching section mating with said entry section of said earmold to latchably secure said connector member in said earmold, said tubing-receiving section having a diameter to receive a second end of said sound conduction tubing therein; and a filter disposed in said tubing-receiving section adjacent to the second end of said sound conduction tubing.

2. A hearing aid system as claimed in claim 1, wherein an internal diameter of the sound conduction tubing is the same as a diameter of said sound conduction tubular passage, so that said sound conduction tubular passage has the same diameter as the exit section of said sound conduction bore.

3. A filtered connector for connecting sound conduction tubing from a hearing aid to a sound conduction bore of an earmold, comprising:

an elbow-shaped member having a tubing-receiving section and a latching section, said elbow-shaped member having a sound conduction tubular passage extending from said tubing-receiving section to an outer end of said latching section;

said tubing-receiving section having a bore larger in diameter than said sound conduction tubular passage and substantially the same as an external diameter of the sound conduction tubing so that an end of the sound conduction tubing is fitable within said bore;

a shoulder located at an intersection of the bore and the sound conduction tubular passage;

a filter positioned in said bore against said shoulder so that when the sound conduction tubing end is fitted within said tubing-receiving section, the sound conduction tubing end engages said filter thereby securing said filter within said tubing receiving section; and said latching section adapted to be fitted into the sound conduction bore of the earmold thereby latching the elbow-shaped member to the earmold.

4. A filtered connector as claimed in claim 3, wherein an internal diameter of the sound conduction tubing, the sound conduction tubular passage and the sound conduction bore have the same diameter.

5. A hearing aid system as claimed in claim 1, wherein said tubing-receiving section has a shoulder against which said filter engages.

* * * * *